United States Patent [19]

Beddome

[11] 3,992,167

[45] Nov. 16, 1976

[54] LOW TEMPERATURE REFRIGERATION PROCESS FOR HELIUM OR HYDROGEN MIXTURES USING MIXED REFRIGERANT

[75] Inventor: Robert Arthur Beddome, North Tonawanda, N.Y.

[73] Assignee: Union Carbide Corporation, New York, N.Y.

[22] Filed: Apr. 2, 1975

[21] Appl. No.: 564,435

[52] U.S. Cl. ..... 62/18; 62/39; 62/40; 62/26; 62/23; 423/649

[51] Int. Cl.[2] ..... F25J 3/00

[58] Field of Search ..... 62/38, 39, 18, 40, 26, 62/23; 423/649

[56] References Cited

UNITED STATES PATENTS

| | | | |
|---|---|---|---|
| 2,932,173 | 4/1960 | Mordhorst et al. | 62/40 |
| 2,990,914 | 7/1961 | Kniel | 62/39 |
| 3,010,286 | 11/1961 | Baker et al. | 62/17 |
| 3,021,682 | 2/1962 | Baker et al. | 62/17 |
| 3,095,274 | 6/1963 | Crawford | 423/649 |
| 3,180,709 | 4/1965 | Yendall et al. | 423/649 |
| 3,182,461 | 5/1965 | Johanson | 62/38 |
| 3,233,418 | 2/1966 | Shaievitz | 62/38 |
| 3,389,565 | 6/1968 | Ergenc | 62/26 |
| 3,396,784 | 8/1968 | Ergenc et al. | 62/38 |
| 3,516,262 | 6/1970 | Bernstein | 62/39 |
| 3,801,708 | 4/1974 | Smith et al. | 62/17 |

*Primary Examiner*—Norman Yudkoff
*Assistant Examiner*—J. Sofer
*Attorney, Agent, or Firm*—John C. LeFever

[57] ABSTRACT

A low temperature refrigeration process wherein a feed gas mixture comprising hydrogen or helium as major component and a minor component with normal boiling point above 170° K and molecular weight of at least 28 is dynamically compressed at higher temperature and cooled to intermediate temperature for condensation and separation of the minor component. Pure major component is further cooled and work expanded at lower temperature and recycled for mixing with the condensed minor component during rewarming to form at least the major fraction of the feed gas mixture.

14 Claims, 2 Drawing Figures

LOW TEMPERATURE REFRIGERATION PROCESS FOR HELIUM OR HYDROGEN MIXTURES USING MIXED REFRIGERANT

This invention relates to an improved low temperature refrigeration process wherein hydrogen or helium is employed as the refrigerant fluid to produce refrigeration temperature levels on the order of 20° K and lower.

The production of refrigeration at temperature levels of 20° K and lower conventionally requires the use of hydrogen or helium as a refrigerant medium in a flow circuit wherein the refrigerant gas is compressed at the warm end of the circuit, cooled and expanded at the cold end. In some applications, a fraction of the gas is liquefied and withdrawn as product at the lower temperature level, but regardless of the application, the major fraction of the refrigerant is rewarmed and circulated back to the compression step.

Due to the low molecular weights of hydrogen and helium, the pumping of heat from low temperature levels in the aforedescribed systems requires the recirculation of large volumes of gas through the steps of compression, cooling and expansion. Such volume requirements make the compression step both difficult and expensive.

In conventional refrigeration systems, three major types of compression equipment are generally used. These include centrifugal (rotary) compression, wherein rotating impeller wheels apply centrifugal force to the gas to produce dynamic pressure head, and reciprocating compressors which operate by positive displacement mechanical compression of the gas. Screw compressors are also occasionally employed but their adiabatic efficiency is quite low. In hydrogen and helium refrigerant low temperature systems of the above type rotary compressors are usually impractical because the rotors must be large in size, turn at high speed and be provided in great number in series in order to obtain appreciable pressure levels. Typically, the head developed across a single impeller wheel of a rotary compressor running at normal speed is on the order of 10,000 feet of the fluid being compressed. At ambient conditions (1 atm., 70° F), the density of pure helium is only 0.0103 lbs. per cu. ft. so that 10,000 feet pressure head provides only 0.72 psi compression across the first or lowest pressure wheel of the compressor. The density of pure hydrogen is only 0.0052 lb. per cu. ft. so that 10,000 feet pressure head provides only 0.36 psi compression. Since pressure levels on the order of 100 to 300 psia are generally required in hydrogen and helium low temperature refrigeration systems, it is apparent that the use of centrifugal compression therein would require compressor equipment containing an extremely high number of large diameter impeller wheels, with consequent adverse effect on the economy of the process. As a result of the foregoing disadvantages, hydrogen and helium are characteristically compressed in reciprocating compression equipment in low temperature refrigeration systems. Nonetheless, because the volume of recirculating gas is so great, these compressors are also very large in size, and represent an inordinately large part of the total cost of the refrigeration system.

In recent years, applications have appeared involving relatively huge refrigeration requirements at temperature levels on the order of 20 K and lower. Liquid hydrogen is needed in substantial amounts for rocket fuel. Superconducting electric power cables are undergoing fullscale development and require refrigeration below 20° K and down to liquid helium level in quantities far greater than heretofore produced. Superconducting magnets are similarly being developed and used for such extensive purposes as magnetically levitated trains and electric power generators. Because of the aforementioned compression problems, the compression equipment for these applications becomes impractical in size and cost.

Accordingly, it is an object of the present invention to provide an improved method of producing refrigeration at temperature levels on the order of 20° K and lower.

It is a further object of the invention to provide an improved low temperature process wherein hydrogen or helium is employed as the refrigerant fluid to produce such refrigeration levels.

It is a still further object of the invention to provide such refrigeration using economical centrifugal compression of the refrigerant fluid.

Other objects and advantages of this invention will be apparent from the ensuing disclosure and claims.

SUMMARY

This invention relates to a low temperature refrigeration process in which a feed gas mixture is provided at superatmospheric pressure comprising a major component selected from the group consisting of hydrogen and helium, and at least 5% by volume of a minor component having a normal boiling point above 170° K and a molecular weight of at least 28. The feed gas mixture is cooled to a temperature of between 80° and 140° K and above the freezing point of the minor component for liquefaction of the minor component, and the liquefied minor component is separated from the cooled feed gas mixture to produce cooled minor coponent-depleted feed gas.

The cooled minor component-depleted feed gas is contacted with an adsorption zone at the low temperature of the feed gas for selective removal of the residual minor component therein and pure major component is discharged from the adsorption zone. At least part of this pure major component is further cooled to a temperature at about its boiling point. A portion of the pure major component is expanded to lower pressure with the production of external work and cooling thereof to lower temperature above its boiling point, and lower pressure pure major component comprised at least in part of the work expanded portion of the pure major component is partially rewarmed by heat exchange with the pure major component as at least part of the aforementioned further cooling of the latter to a temperature at about its boiling point.

The above-described liquefied minor component which has been separated from the cooled feed gas mixture is throttled to the lower pressure of the partially rewarmed pure major component and joined with the partially rewarmed pure major component to form a recycle gas mixture. This recycle gas mixture is further rewarmed to vaporize the liquefied minor component therein by heat exchange with the feed gas mixture as at least part of the aforementioned cooling of the latter to a temperature of between 80° and 140° K and above the freezing point of the minor component. The further rewarmed recycle gas mixture is dynamically compressed and provided as at least the major fraction of the first mentioned superatmospheric pressure feed gas mixture.

As used herein, the term "dynamically compressing" refers to gas compression in a dynamic-type centrifugal compressor wherein a rotary component imparts energy to the gas by virtue of centrifugal force and high velocity which is subsequently converted into pressure head. Such compressors may be of any suitable conventional type including axial-flow and rotary vane machines.

As used herein, the term "boiling point", unless otherwise noted, refers to the boiling point of the fluid at the local pressure conditions in the process and "at about its boiling point" refers to temperature generally below about 30° K. In the case of helium for example, whose normal boiling point is 4.2° K, temperatures at about its boiling point may suitably include temperatures at least as high as 14° K, where some present day metals and alloys become superconductive.

It will be understood that the term "recycle gas mixture" as used to describe the mixture formed by the partially rewarmed pure major component and the liquefied minor component prior to the further rewarming step refers to a two-phase fluid mixture and that the term "gas" is used broadly to refer to both gas and vapor.

The method of this invention permits a substantial economy incompression equipment to be achieved with the use of centrifugal equipment of relatively low cost and small size. The improvements afforded by the invention are achieved largely by the companion features of admixture of the low molecular weight major component with a relatively high molecular weight minor component, together with recycle gas mixture further rewarming step to vaporize the liquefied minor component therein. The admixture of high and low molecular weight constituents yields a mixture having a relatively high 'apparent' molecular weight which is readily compressed in rotary centrifugal machines of low cost and small size. If the major component of hydrogen or helium were separately compressed, reciprocating machines of large size would be required and this cost would be several-fold greater than rotary compressors.

However, the aforestated economy in compression equipment could not be fully realized without the companion feature of vaporization of minor component in the recycle gas mixture during the further rewarming step. Admixing the higher boiling minor component with the gaseous major component prior to vaporization of the minor component significantly increases the efficiency of the process. The effect of such mixing is to reduce the partial pressure of the minor component in the vapor phase so that vaporization takes place at much lower temperatures than if the major and minor components were to be rewarmed separately. By mixing the two components, the latent refrigeration of the minor component is made available at a lower temperature level and this substantially reduces the refrigeration demand placed on the cold end of the process. Thus, if the major and minor components were rewarmed separately, relatively more major component would have to be recirculated from the cold end and through the rewarming steps back to the compression step, so that even if the separately warmed components were mixed prior to compression, the further rewarmed recycle gas mixture would be richer in major component and lower in apparent molecular weight. As a result, the freedom to employ low cost rotary compression equipment would no longer be assured. The invention therefore permits the use of dynamic compression rotary equipment having only a low number of rotary stages (impeller wheels), consonant with significant overall improvement in the efficiency and economy of the low temperature refrigeration process.

DESCRIPTION OF THE PREFERRED EMBODIMENTS

Figure 1:
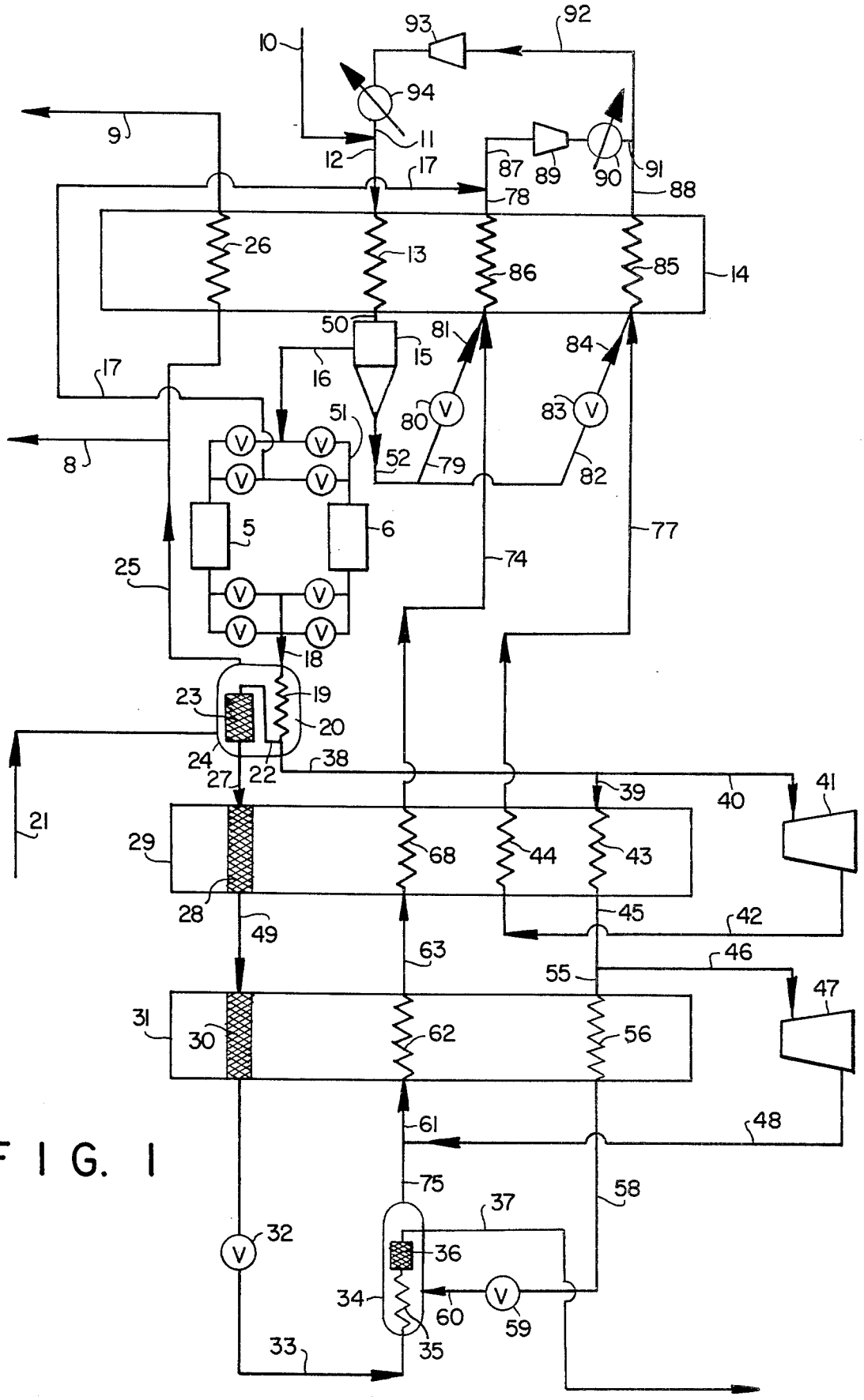
FIG. 1 is a schematic flowsheet of a low temperature refrigeration process according to one embodiment of the invention, suitable for producing liquid hydrogen as a refrigerant product at a temperature in the vicinity of 20° K.

Referring now to the drawings, FIG. 1 shows an illustrative process system according to the present invention wherein hydrogen is liquefied for use as low temperature refrigerant.

In the following descriptions, all flow rates will be understood to refer to flows based on normal temperature and pressure conditions of 70° F and atmospheric pressure.

In the illustrative process, a feed stream of purified hydrogen at a flow rate of $10 \times 10^6$ cubic feet per hour (cfh), pressure of 345.0 psia and temperature of 308.0° K is introduced in line 10 and is joined with the mixed gas recycle stream in line 11 at a rate of 73,550,000 cfh and at the same temperature and pressure conditions as the hydrogen feed stream. The feed stream of purified hydrogen gas may be obtained from any suitable source as for example stream reforming or partial oxidation processes of conventional type, such sources not being critical to the operability nor forming any part of the present invention. The mixed gas recycle stream consists of 67% hydrogen major component and 33% propane minor component and upon combination with the feed stream in line 10 forms the feed gas mixture in line 12 consisting of 70.2% hydrogen major component and 29.8% propane minor component. The feed gas mixture flowing at a rate of 83,550,000 cfh and temperature of 308.0° K is passed through line 12 and introduced into passage 13 of first heat exchanger 14 for cooling therein by indirect heat exchange with the process streams (to be described more fully hereinafter) in heat exchanger passages 26, 85 and 86. The cooling in heat exchanger 14 causes liquefaction of the propane minor component, with the cooled feed gas mixture being discharged from exchanger passage 13 into line 50 at a temperature of 102.8° K. At this temperature, which is above the freezing point of the minor component, essentially all of the propane is condensed and the condensate is deeply subcooled so that the residual propane in the vapor phase is less than 1 part-per-million (ppm).

The cooled feed gas mixture is next passed by line 50 into phase separator 15 wherein the liquefied minor component propane is separated from the cooled feed gas mixture to produce cooled minor component-depleted feed gas. Minor component-depleted feed gas is withdrawn from the separator at a rate of 49,060,000 cfh in line 16 and introduced to adsorption zone 51, comprising two absorbent beds at 5 and 6.

In the adsorption zone, the cooled minor component-depleted feed gas is contacted with a suitable adsorbent at the low temperature of the cooled feed gas for selective removal of the residual minor component therein, with discharge of pure major component hydrogen from the zone in line 18. The adsorption zone may for example contain activated carbon as the adsorbent materials such as silica gel or molecular sieves may be suitably employed. The adsorption zone itself may be operated in any of several modes well-known to those skilled in the art. For example, thermal swing adsorption is a common method of operation wherein an adsorbent bed is actively employed to selectively remove one or mor components from a gas stream until the bed is at least partially loaded with the adsorbed species, whereupon the bed is taken off-stream and warmed, purged and recooled to restore its capacity for further active adsorption operation. Pressure swing adsorption is also commonly employed, whereby the adsorbent bed is operated at higher pressure for selective removal of the sorbable components, followed by depressurization to lower pressure, purging and repressurization. A combination of the two methods may also be employed in accordance with the present invention wherein an adsorbent bed is both warmed and depressurized during desorption of the minor component. Regardless of the specific mode of operation employed, however, it is preferred to provide an adsorption zone comprising at least two adsorbent beds suitably manifolded together for alternating sequential operation, such that at any given time one bed is on-stream in the active adsorption step while another bed is off-stream and undergoing regeneration so as to provide for continuous adsorption operation. In such an adsorption zone, it is preferred to employ pure major component for purging of a bed having previously been at least partially loaded with residual minor component and to recycle the gas removed from that bed during desorption thereof to provide a constituent of the recycle gas mixture. The pure major component for purging the off-stream bed may suitably comprise a small fraction of the pure major component diverted from the discharge end of the on-stream bed. In the FIG. 1 system, the gas removed from the off-stream bed during desorption is recycled for joining with recycle gas mixture by means of line 17.

The pure major component hydrogen discharged from the adsorption zone flows through line 18 and enters heat exchange passage 19 immersed in a bath of liquid nitrogen 20 contained in vessel 24. Liquid nitrogen is supplied to vessel 24 via line 21 from an external source (not shown), such as an air separation plant, at a flow rate of 7,120,000 cfh, temperature of 81° K and pressure of 22 psia. Alternatively the external refrigeration source could suitably comprise a conventional cascade system or other mechanical refrigeration source. In the liquid nitrogen bath, the pure major component is additionally cooled in passage 19 to a temperature of 80° K and divided into a major part and a minor part, the major part being discharged from vessel 24 at a flow rate of 49,060,000 and pressure of 340 psia in line 38 and the minor part comprising the product stream part of the pure major component being passed through line 22 at a flow rate of $10 \times 10^6$ to be contacted with an ortho-para conversion catalyst in reactor 23. In reactor 23, the minor part hydrogen stream is catalytically converted to yield a para content of 47.5.% and the converted stream is discharged from vessel 24 in line 27 at a pressure of 318.7 psia and temperature of 80° K.

The refrigeration for the removal of heat from reactor 23 during the exothermic catalytic conversion step and for the cooling of pure major component in passage 19 is supplied by the vaporization of the nitrogen in vessel 24, and nitrogen gas is discharged therefrom in line 25 at a pressure of 22 psia and temperature of 81° K. The refrigeration in the nitrogen gas is partially recovered in passage 26 of first heat exchanger 14 by flow therethrough of 2,310,000 cfh of the gas, with the remainder of the gas being removed from the boil-off stream upstream of the heat exchanger in line 8. The nitrogen gas in lines 8 and 9, the latter containing the rewarmed gas discharged from heat exchanger 14, may be recirculated to the external refrigeration system or otherwise suitably disposed of.

The conversion catalyst contained in reactor 23 may suitably comprise ferric oxide gel, chrome oxide or any other of a variety of catalyst materials conventionally employed for such purpose, as well-known to those skilled in the art. A high extent of conversion of hydrogen to the para form is desirable in the practice of the invention when hydrogen is removed from the process as a liquid refrigerant product. At liquid hydrogen temperatures in the vicinity of 20° K the equilibrium concentration of para hydrogen is close to 100%. If the withdrawn liquid hydrogen product has not been catalytically converted, the ortho-hydrogen content thereof may be as high as 75% (corresponding to the normal equilibrium ortho content at ambient temperature). Such high ortho content is due to the fact that the ortho to para conversion is relatively slow and may not have had time to take place to an appreciable extent during the rapid liquefaction process. Thereafter, the occurrence of the ortho to para transformation, being highly exothermic, will cause significant vaporization of the hydrogen liquid and corresponding depletion of the liquid product. For this reason, it is preferred in the practice of the invention, wherein hydrogen is withdrawn as a liquid product and placed in storage or subjected to other use where it is desirable to minimize boil-off losses of the liquid, to contact the hydrogen with an ortho/para conversion catalyst during the cooling and further cooling steps of the process to produce liquid hydrogen product having a para content of at least 50% and preferably at least 75%.

The pure hydrogen stream in line 27 is further cooled to a temperature at about its boiling point by the steps to be described hereinbelow. This stream is first introduced to passage 28 of second heat exchanger 29 for cooling therein to a temperature of 53.4° K and thereafter is passed via line 49 to passage 30 of third heat exchanger 31 for cooling therein to a temperature of 21.75° K. Since the equilibrium content of para-hydrogen increases at lower temperatures, the further cooling of stream 27 permits additional catalytic conversion and such conversion is accomplished by conversion catalyst of a type described hereinabove contained within the passages 28 and 30 of heat exchangers 29 and 31 respectively. Such heat exchangers may suitably be of a type as disclosed and claimed in U.S. Pat. No. 3,213,933 issued Oct. 26, 1965 in the name of G. L. Kasparian. Under the aforedescribed stream conditions, catalytic conversion is conducted to provide a para-hydrogen content of 65.6% in line 49 and 99.3% in line 33 containing the steam discharged from third heat exchanger 31.

The pure hydrogen stream in line 33, initially at a pressure of 289.7 psia upstream of expansion valve 32, is throttled by the valve to a pressure of 25.7 psia. During the throttling the temperature of the hydrogen increases slightly to 22.6° K due to the Joule-Thomson inversion effect. Before withdrawing the throttled hydrogen to storage or other disposition, it is desirable to totally liquefy and subcool the stream and to complete the orotho-para conversion to equilibrium conditions corresponding to the lowest process temperature. This is accomplished in heat exchanger-para converter 34 which is refrigerated by unconverted lower pressure hydrogen produced by steps described hereinafter. Exchanger-converter 34 contains heat exchanger passage 35 and catalytic reactor 36, both immersed in a bath of liquid hydrogen. Catalytic reactor 36 suitably contains a catalyst of the type described earlier herein. The stream in line 33 is further cooled in passage 35, catalytically converted in reactor 36 and discharged from the system as product stream in line 37 at a flow rate of $10 \times 10^6$ cth, temperature of 21.3° K, pressure of 24.7 psia and parahydrogen content of 99.7%.

As described hereinabove the major part of the pure major component additionally cooled in vessel 20 is discharged therefrom in line 38, at a flow rate of 49,060,000 cfh, pressure of 340 psia and temperature of 80° K. From line 38, the major part of the pure major component is divided, with a first smaller part thereof at a flow rate of 18,310,000 cfh, passing into line 40 and entering first turbine 41. In turbine 41, the first smaller part hydrogen stream is expanded to lower pressure with the production of external work and is cooled to lower temperature, being discharged from the turbine into line 42 at an first intermediate pressure of 80.7 psia and temperature of 50.9° K. The expanded first smaller part gas flows through line 42 and is introduced into passage 44 of second heat exchanger 29 for partial rewarming therein by heat exchange with the pure major component being further cooled in passage 28. After partial rewarming, the first smaller part hydrogen stream enters line 77 for recirculation to the warm end of the process.

The remainder of the major part of the pure major component not diverted to first turbine 41 is flowed in line 39 to the heat exchange passage 43 in exchanger 29, cooled therein to a temperature of 54.8° K and discharged in line 45 from which it is divided into two further streams in lines 46 and 55. The stream in line 46 comprising a second larger part of the pure major component major part at a flow rate of 29,610,000 cfh, enters second expander 47 for work expansion and cooling therein. The shaft work produced by the turbines 41 and 47 may suitably be recovered and employed to drive the centrifugal compression equipment in the refrigeration system or alternatively employed as desired. Expanded second larger part as at lower-than-intermediate pressure of 18.7 psia and temperature of 21.8° K is discharged from turbine 47 into line 48 and flowed therethrough to line 61 where it is joined with the boil-off hydrogen gas from product subcooler 34 flowing in line 75 at a rate of 1,140,000 cfh. The combined stream comprising second larger part gas flows by line 61 into passage 62 of third heat exchanger 31. The combined stream is first partially rewarmed to a temperature of 51.5° K in the third heat exchanger by heat exchange with the pure major component being further cooled in passage 30 and is thereafter passed by means of line 63 to passage 68 of a second heat exchanger 29. In the second heat exchanger, the second larger part combined stream is second partially rewarmed to 79° K by heat exchange with pure major component being further cooled in passage 28. The partially rewarmed second larger part stream is then recirculated to the warm end in line 74.

The diversion of second larger part gas in line 46 from the pure major component major part gas in line 45 provides a third smallest part of major component gas in line 55 which is passed through third heat exchanger passage 56 for cooling therein to 22.6° K, discharged from the exchanger in line 58, throttled in valve from 339.2 psia to 18.5 psia and lower temperature of 21.3° K, and finally introduced via line 60 into product subcooler 34 at a flow rate of 1,140,000 cfh to produce refrigeration therein. Heat is absorbed from the product stream in the subcooler for complete condensation, subcooling and final para-conversion, and the liquid delivered to the boiling side is vaporized and the vapor discharged from the subcooler by line 75, as described hereinabove.

To review briefly the lower temperature section of the refrigeration system, it is seen that almost all (approximately 98%) of the major part of the pure major component is work expanded in parallel-connected warm and cold turbines 41 and 47. In the above description, the hydrogen gas which is conducted by lines 40 and 46 to the respective turbines 41 and 47 comprises the "portion" of the pure major component which is expanded to lower pressure, as set forth in the language of the preceding Summary section. The lower pressure expanded streams from the turbines are partially rewarmed against streams being further cooled, including the minor part of the pure major component. The partially rewarmed expanded streams are recycled to the warm end of the system in lines 74 and 77 for further warming and recirculation.

The aforedescribed liquefied minor component propane separated from the cooled feed gas mixture in separator 15 is subsequently removed in line 52 and divided into two parts. The first part is flowed through line 82 at a rate of 9,430,000 cfh, throttled in valve 83 to the intermediate pressure of 79.7 psia and lower temperature of 79.0° K, flowed through line 84 and finally admixed with the first smaller part pure major component stream at the same process conditions to form a first intermediate pressure part of the recycle gas mixture for the system. In similar manner, the second part of the liquefied minor component is flowed through line 79 at a rate of 15,080,000 cfh, throttled in valve 80 to lower-than-intermediate pressure of 16.4 psia and temperature of 79.0° K, flowed through line 81 and finally admixed with the second larger part pure major component to form a second lower-than-intermediate pressure part of the recycle gas mixture.

After admixing, the first and second parts of the recycle gas mixture, which consist of two-phase gas-liquid mixtures, are conducted through passages 85 and 86, respectively, of the first heat exchanger 14. whereas passages 85 and 86 are depicted schematically as single passages, in actual practice, each of recycle gas mixture parts with propane admixture therein is preferably divided among multiple passages in heat exchanger 14. The admixture of throttled liquid propane into gaseous hydrogen for each recycle gas mixture part is accomplished at the entrance to the heat exchanger, with the propane and hydrogen being distributed evenly among the multiple passages and in uniform proportion. Two-phase entry devices suitable for achieving such uniform distribution are well-known to those skilled in the art and need not be described here. In the heat exchanger the recycle gas mixture first and second parts are further rewarmed to vaporize the liquefied minor component therein by heat exchange with the feed gas mixture being cooled in passage 13. After further rewarming, the second part recycle gas mixture is discharged from the exchanger in line 78, joined with any gas flowing in line 17 from the adsorption zone 51 and thereafter passed through line 87 at the flow rate of 45,830,000 cfh, pressure of 16.7 psia and temperature of 307.0° K to centrifugal compressor 89. In compressor 89 the second part recycle gas mixture is dynamically compressed to the intermediate pressure and then cooled in aftercooler 90 disposed in discharge line 91. The compressed intermediate pressure second part recycle gas mixture in line 91 is then joined with the first part recycle gas mixture flowing from the first heat exchanger 14 in line 88 to form the recycle gas mixture. Prior to being joined, both of these recycled gas streams are at the same pressure of 77.7 psia and temperature of 307.0° K. After joining, the recycle gas mixture flows through conduit 92 at a rate of 73,550,000 cfh with a composition of 67.0% hydrogen and 33.0% propane to centrifugal compressor 93 for further dynamical compression to 345.0 psia. The further compressed recycle gas mixture is discharged to line 11, cooled in aftercooler 94 therein and thereafter provided as the major fraction (approximately 88.0% by volume) of the superatmospheric pressure feed gas mixture formed by joining the recycle gas mixture with the influent hydrogen stream entering in line 10.

As discussed earlier, admixing the higher boiling propane with the gaseous hydrogen prior to vaporization of the former significantly increases the efficiency of the process. The effect of such mixing is to reduce the partial pressure of propane in the vapor phase so that vaporization commences at much lower temperatures in passages 85 and 86 than would otherwise occur. For example, propane vaporization will commence in passage 86 at a temperature of about 190°–200° K, whereas if pure propane stream 84 were vaporized without admixture, i.e., with hydrogen major component in a separate passage in exchanger 14, the propane minor component would commence vaporization at the much warmer temperature of about 233° K. By such mixing, the latent refrigeration of the propane is made available at a lower temperature level and this reduces substantially the refrigeration demand placed on expanders 41 and 47.

As a consequence of the foregoing behavior, the investment in recycle compressors 89 and 93 is substantially reduced. The 'apparent' molecular weight of the first and second part recycle gas mixtures, each comprising about 67% hydrogen and 33% propane, is about 15.7 and therefore the mixed gas is readily compressed in rotary centrifugal machines of relatively low cost and small size. If the hydrogen component of the recycle stream were separately compressed at a molecular weight of 2, reciprocating machines of huge size would be required and their cost would be several-fold greater than rotary compressors. A rotary machine which compresses pure hydrogen and delivers a discharge stream having a pressure of 345 psia must contain a very large number of impeller wheels. By comparison, a compressor designed to deliver 345 psia with the mixed recycle gas of the foregoing description would need only about 12 wheels.

The aforestated economy in compression equipment could not be fully realized without the companion feature of mixed-vaporization of propane in passages 85 and 86. It was stated previously that without mixed-vaporization, the cold-end refrigeration load would be increased. This would increase substantially the volume of the recycle hydrogen streams in lines 74 and 77. The volume of propane stream 52 could not economically be increased proportionately because warm-end temperature differences — already larger as a result of separate vaporization of propane — would be spread even further. Therefore, even though the separately warmed components of the recycle stream were mixed prior to compression, the result would be a mixture richer in hydrogen and lower in apparent molecular weight, which may in turn preclude the use of low cost rotary compressors.

Figure 2:
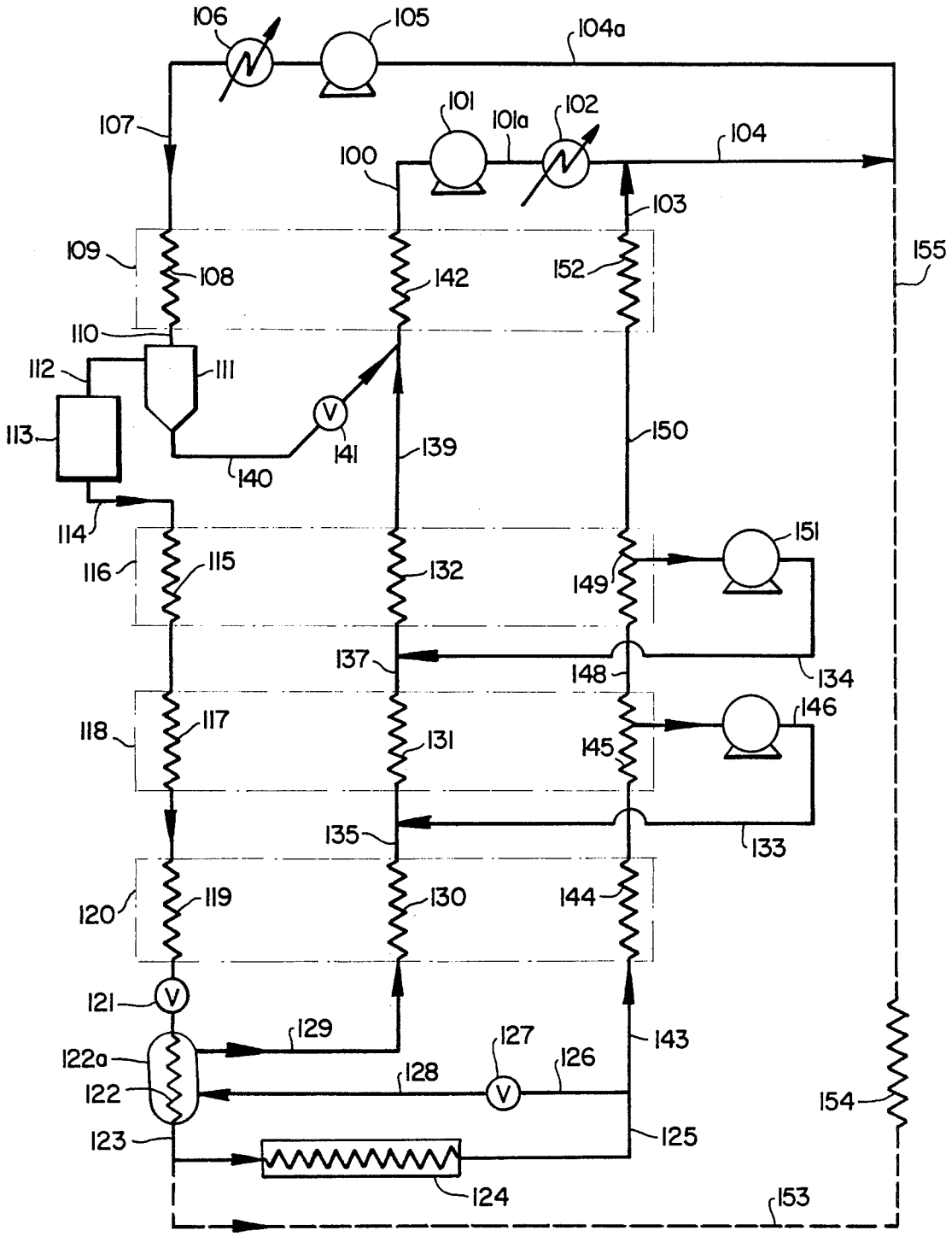
FIG. 2 is a schematic flowsheet of a low temperature refrigeration process according to another embodiment of the invention, suitable for developing 4° – 5° K refrigeration using helium as the refrigerant fluid.

FIG. 2 herein is a schematic flowsheet of another embodiment of the invention adapted for developing 4°–5° K refrigeration using a feed gas mixture comprising helium as the major component and refrigerant R-12 (dichlorodifluoromethane) as the minor component. The system is closed, i.e., a liquid product is not withdrawn from the process as in the FIG. 1 embodiment.

In the illustrated system, a feed gas mixture is provided having a composition of 86.2% helium and 13.8% R-12, at a pressure of 146 psia and flowing at a rate of 347,200 cfh in line 107. This feed gas mixture flows through passage 108 of first heat exchanger 109 and is cooled to a temperature of 120° K, which is about 5° above the freezing point of the pure R-12 component. At this temperature, the R-12 component is condensed and deeply subcooled, such that it exerts essentially no vapor pressure. The liquefied R-12 minor component is separated and collected in phase separator 111 and the uncondensed cooled minor component-depleted feed gas comprising substantially pure helium with only about 1 ppm of R-12 refrigerant is withdrawn at a rate of 312,200 cfh from the separator as stream 112.

The cooled minor component-depleted feed gas is then contacted with adsorption zone 113 at the low temperature of the cooled feed gas for selective removal of the residual R-12 therein and pure major component helium is discharged from the zone in line 114. Although the adsorption zone has been schematically shown for simplicity as a block element in the drawing, the adsorption zone is preferentially of a type described hereinabove in connection with FIG. 1 having at least two adsorbent beds wherein one of the beds is actively adsorbing at any given time while the other is undergoing desorption as by warming and purging to remove the previously adsorbed R-12 component.

The purified helium stream in line 114 is further cooled in a series of heat exchange steps to a temperature at about its boiling point. This further cooling comprises sequential cooling first in passage 115 of second heat exchanger 116 to a temperature of 32° K, then in passage 117 of third heat exchanger 118 to a temperature of 10.5° K and next in passage 119 of fourth heat exchanger 120 to a temperature of 4.96° K. The cold stream withdrawn from passage 119 at a pressure of 140 psia is throttled in valve 121 to a pressure of 100 psia and a slightly higher temperature of 5.2° K owing to Joule-Thomson expansion, then is finally further cooled in passage 122 by heat exchange with boiling liquid helium, and is delivered as further cooled pure major component helium in line 123 at a temperature of 4.57° K.

At this pressure (100 psia) the helium stream in line 123 is super-critical and does not liquefy. A major fraction of the further cooled helium is conducted at a flow rate of 306,700 cfh to external refrigeration load 124 which may, for example, constitute the cooling system of a superconducting magnet or power transmission system. In passing through the refrigeration load 124, the deeply cooled helium is prewarmed and emerges as a stream in line 125 at a temperature of perhaps 5° K. This stream is now divided, with a minor part thereof in line 126 at a flow rate of 58,100 cfh being throttled in valve 127 to a pressure of about 16.2 psia to provide pure major component helium at lowest process temperature of 4.33° K. A fraction of the throttled helium is liquefied thereby and the resulting two-phase fluid is passed by line 128 into the heat exchanger 122*a* in indirect heat exchange relationship with the pure major component helium in passage 122 as the final part of the further cooling of the latter stream. In heat exchanger 122*a*, the throttled liquid helium and a vaporized helium stream is discharged in line 129. This vaporized helium at lower pressure level is then partially rewarmed against the pure major component being sequentially further cooled, by the flow of minor part gas through passage 130 of fourth heat exchanger 120 for partial rewarming therein to 10° K, followed by rewarming of the augmented stream in passage 131 of third heat exchanger 118 to a temperature of 31° K and final partial rewarming of the further augmented gas stream in passage 132 of second heat exchanger 116 to a temperature of 118° K, with a second part recycle gas formed by the addition of the streams in lines 133, 134 and 135 being discharged from the second heat exchanger into line 139 for recirculation back to the warm end of the process.

Refrigeration for the process is developed in a two turbine system wherein a portion of the purified helium stream being rewarmed is work expanded at different temperature levels. After the low temperature helium in line 125 is divided, the major part thereof at an higher intermediate pressure of 96 psia is flowed in line 143 at a rate of 248,600 cfh to the partial rewarming steps. Three partial rewarming steps are employed, wherein the low temperature helium gas is first partially rewarmed in passage 144 of fourth heat exchanger 120 to a temperature of 10° K, followed by further partial rewarming in passage 145 of third heat exchanger 118 to a temperature of 31° K and final partial rewarming in passage 149 of second heat exchanger 116 to a temperature of 118° K.

At appropriate points in the rewarming passages of the third and second heat exchangers, first and second expansion portions are respectively diverted from the major part gas. The diverted helium gas is then expanded to lower pressure with the production of external work and cooling thereof to lower temperature above its boiling point. In passage 145 of the third heat exchanger 118, a first portion gas stream comprising 91,600 cfh helium at a temperature of 16.6° K is diverted from the major part gas stream by means of line 133 and is delivered to first expander 146. The expanded stream discharged from expander 146 at lower than intermediate pressure of 15.9 psia and a temperature of 10° K is flowed through line 133 and joined with the heat exchanged minor part gas to form an augmented gas stream for flow through third heat exchanger passage 131.

In passage 149 of the second heat exchanger 116, a second portion gas stream at pressure of 95.5 psia and temperature of 49.9° K is diverted from the major part gas stream in line 134 at a flow rate of 50,300 cfh and conducted to second expander 151. The diverted second portion gas is expanded in expander 151 to lower than intermediate pressure of 15.1 psia and a temperature of 31° K. The remaining major part gas stream, which has been reduced in size by the removal of the first and second portion gas streams, comprises the first part recycle gas for the system which is finally partially rewarmed in the terminal part of second heat exchanger passage 149 and discharged into line 150 at a pressure of about 95 psia and a flow rate of 106,700 cfh for recirculation to the warm end of the process.

The expanded second portion gas stream discharged from expander 151 is flowed through line 134 and joined with the augmented gas stream in line 137 to form the second part recycle gas for the system. This second part recycle gas is finally partially rewarmed in second heat exchanger passage 132 and discharged into line 139 at a flow rate of 200,000 cfh.

The lower-than-intermediate second part recycle helium stream in line 139 is next remixed with the R-12 condensate from separator 111. Liquefied minor component R-12 is withdrawn from the separator at a flow rate of 35,000 cfh through line 140 at a pressure of 142 psia and is throttled in valve 141 to the lower-than-intermediate pressure of the second part recycle gas, i.e., about one atmosphere. The throttled liquefied R-12 is then joined with the second part recycle gas in line 139 to form a two-phase second part recycle gas mixture at a flow rate of 235,000 cfh which is then further rewarmed in passage 142 of the first heat exchanger 109. During the further rewarming, the liquefied minor component R-12 in the second part recycle gas mixture is vaporized. As in the case of the further rewarming step described hereinabove in connection with the FIG. 1 embodiment of the invention, the vaporization here of the R-12 liquid minor component in direct contact with the helium recycle gas serves to reduce the partial pressure of R-12 in the gas phase so that the R-12 liquid vaporizes at a significantly lower temperature than the boiling point of the pure fluid.

After being further rewarmed to near ambient temperature of approximately 298° K in passage 142 and discharged into line 100, the second part recycle gas mixture is dynamically compressed in first compressor 101 to the intermediate pressure level of the second part recycle gas, i.e., about 95 psia. The compressed gas, having a composition of 80% helium and 20% R-12 flows from the first compressor in line 101*a*, is aftercooled in cooler 102 and is then mixed with the first part recycle gas, which has been further rewarmed in passage 152 of second heat exchanger 109 and flows at the rate of 106,700 cfh through line 103. The mixed stream forms the recycle gas mixture, having a composition of 86.2% helium and 13.8% R-12, which is flowed at temperature of 341,700 cfh through conduits 104 and 104*a* to the second compressor 105. In compressor 105, the recycle gas mixture is further dynamically compressed to a pressure of 146 psia. The further compressed gas is aftercooled in cooler 106 and then flowed into line 107 at a rate of 347,200 cfh as the superatmospheric pressure feed gas mixture for the process.

The foregoing low temperature system provides the same qualitative advantages in the use of centrifugal compressors 101 and 105 as are realized in the previously described embodiment of FIG. 1. Pure helium with a molecular weight of 4 presents problems in compression similar to those described for hydrogen. Large, high cost reciprocating machines are normally required, because rotary compressors would necessarily entail an impractically large number of impeller wheels or stages. The admixture of R-12 with the helium produces an apparent molecular weight of 27.4 in the stream in line 100 and 20.1 in the stream in line 104*a*, thereby facilitating rotary compression with a comparatively small number of wheels.

The foregoing low temperature refrigeration system is particularly useful for cooling equipment remote from the refrigeration system, such as superconducting power cables, magnets or rotating machinery. In such applications, it is advantageous to conduct the deeply cooled helium at a substantial pressure, such as 100 psia, through the external refrigerant circuit. The substantial pressure is desirable in the external circuit because it greatly reduces the size of conduits needed to conduct the helium through the external circuit and return it to the refrigeration process. Moreover, supercritical pressure (≥ 33 psia) is usually required in superconducting power applications in order to preserve the dielectric properties of the fluid. These advantages often outweigh the added cost and complexity of two stages of compression required in order to accommodate the intermediate pressure of the refrigeration circuit.

In the event that it is desirable to service other additional refrigeration loads in the FIG. 2 system and to return helium from such loads at a warm temperature level, the circuit comprising line 153, load 154 and line 155 may suitably be employed. Deeply cooled helium in line 153 is withdrawn from the further cooled stream in line 123, as for example, at a rate of 5,500 cfh, warmed in the secondary load 154, and the resultant warm helium gas at a pressure of about 95 psia is returned by means of line 155 to be joined with the recycle gas mixture flowing in line 104 intermediate compressors 102 and 105. Thus, the circuit through the secondary load bypasses heat exchangers 109, 116, 118 and 120.

Propane-hydrogen and R-12-helium minor-major component combinations have been described in the embodiment herein; however, such pairings of fluids are not critical. Under the invention, a number of other minor components exist which may suitably be employed in combination with either hydrogen or helium as the major component. Summarizing the requirements for the minor component, its boiling point should be at least above 170° K, its molecular weight should be at least 28, its freezing point should be below the temperature (80°–140° K) reached in the feed gas mixture cooling step wherein the minor component is liquefied for subsequent separation, and the feed gas mixture should contain at least 5% and preferably at least 10% by volume of the minor component.

The following Table lists R-12 and propane together with various other components which meet these requirements.

| Minor Component | Molecular Weight | Normal Boiling Point, °K | Freezing Point, °K |
|---|---|---|---|
| Propane ($C_3H_8$) | 44 | 231.1 | 85.5 |
| Propylene ($C_3H_6$) | 42 | 235.5 | 87.9 |
| Ethane ($C_2H_6$) | 30 | 184.5 | 89.9 |
| Ethylene ($C_2H_4$) | 28 | 169.5 | 104.0 |
| R-12 ($C\ Cl_2F_2$) | 121 | 243.4 | 115.0 |
| R-13 ($C\ Cl\ F_3$) | 104.5 | 192 | 92 |

The foregoing compounds may be employed in the practice of this invention either singly or as an appropriate mixture of compounds such as those taught in U.S. Pat. Nos. 3,021,682 and 3,010,286, both issued to C. R. Baker et al. Accordingly, it will be understood that the term 'minor component' as used herein is intended to include both single compounds and multicompound mixtures having the aforedescribed minor component characteristics.

Illustrative of compounds which do not qualify as minor components are the following:

| Compound | Molecular Weight | Normal Boiling Point, ° K | Freezing Point, ° K |
|---|---|---|---|
| Carbon Dioxide ($CO_2$) | 40 | —* | 194.7 |
| Nitrogen ($N_2$) | 28 | 77.5 | 63.2 |
| Methane ($CH_4$) | 16 | 111.7 | 90.7 |
| Argon (A) | 40 | 87.3 | 83.8 |

*Sublimes at 194.7° K at 1 atm. pressure.

The requirements for the minor component, as summarized hereinabove, arise due to various considerations. Due to the fact that the molecular weight of the minor component must be large enought to impart relatively high 'apparent' weight to the recycle gas mixture in the system, together with the functional relationship between molecular weight and normal boiling point, it has been found that the normal boiling point of the minor component should be at least above 170° K, and the feed gas mixture should contain at least 5% by volume of the minor component, consistent with a recycle gas mixture having suitably high apparent molecular weight, in order to minimize the cooling requirements in the warm end of the system. In the warm end of the system, the feed gas mixture must be cooled to condense the minor component for separation prior to the subsequent cooling steps. Such separation is necessary in order that the relatively high molecular weight, minor component does not freeze out on the heat exchange surfaces in the subsequent lower temperature steps and thereby adversely affect the heat exchange steps and the overall process efficiency. If a minor component having a normal boiling point below 170° K were employed, the feed gas mixture cooling requirements in the warm end of the system would be prohibitively large in order to achieve such complete removal of minor component.

In addition to the above, it is preferred that the minor component be characterized by a substantial temperature difference between its boiling point and freezing point. Such temperature difference provides a desirably extensive temperature span over which vaporization will occur. In addition, a wide temperature difference between boiling and freezing is generally associated with a low vapor pressure of the liquid at temperatures near the freezing point.

To illustrate the foregoing preference for a wide temperature difference between boiling and freezing points, all of the acceptable minor components listed above exhibit appreciable temperature differences. The lowest temperature difference among these components is 65.5° K for ethylene and the highest is 147.6° K for propylene. Moreover, all of the acceptable fluids exhibit extremely low vapor pressures at temperatures in the neighborhood of their freezing points such that after the feed gas mixture cooling (condensation) step, the residual concentration of minor component in the gas is not more than a few parts per million.

In contrast, the three fluids in the "unacceptable" list which are considered to be cryogens (nitrogen, methane and argon) have relatively narrow temperature differences between boiling and freezing points, i.e., nitrogen — 21.0° K, methane — 14.2° K, and argon — 3.4° K. All three fluids exhibit relatively high vapor pressures (> 0.1 atmosphere) at temperatures in the vicinity of their freezing points, and after condensation, the residual content of these fluids in the gas phase will be impractically high. Carbon dioxide, of course, is unattractive as a minor component because of its high freezing point which precludes its use as a heat pumping fluid to usefully low temperature levels within the range 80°–140° K.

In the embodiments of FIGS. 1 and 2 described herein, an intermediate pressure stream (i.e., stream 77, 88 in FIG. 1 and stream 150, 103 in FIG. 2) is employed. Three pressure levels are not required in the practice of the invention, and the work expanders in the refrigeration-producing sections of the respective systems could be employed to operate between the higher pressure feed stream and lower pressure recycle stream. For example, in FIG. 2, turbine 151 could expand a portion of the pure major component stream from passage 115 for joining directly with the stream in line 137, and turbine 146 could expand a second portion of the major component stream from passage 17. Of course, such change would cause the temperature levels and flows to change throughout the cooling circuit from the values herein described in connection with FIG. 2, but would not affect the aforedescribed general advantages realized in the instant method.

Under the foregoing considerations, it is not essential in the helium embodiment of FIG. 2 to service the refrigeration load 124 with intermediate supercritical pressure (100 psia) refrigerant. As stated previously intermediate pressure service is often desirable to reduce the size of refrigerant conductors through or within equipment to be cooled, and to preserve dielectric properties of the fluid. In cases where these are not critical factors, valve 121 could throttle the feed to lowest pressure and the feed could then be separated. The vapor would be returned as a single recycle stream, while the liquid would be vaporized in a heat load or delivered as product. Vaporized liquid would then rejoin the single recycle stream.

Both embodiments described herein show two parallel connected turbines operating at different temperature levels. Alternatively, the turbines could be arranged in series with an intervening rewarming step as is well-known in the art. By way of further modification, the present invention may be practised in a refrigeration system employing only a single work expander, rather than two as shown in the embodiments herein. Such a single expander would operate near the temperature level of the colder expanders in the embodiments of FIGS. 1 and 2 and would handle a larger flow than those turbines.

Whereas the embodiments of FIGS. 1 and 2 have been described herein in connection with cycles which develop temperatures at or below the boiling point of the major component, it will be evident that refrigeration can be produced at other temperatures by minor modification within the scope of the invention. Such minor modification involves only the colder steps of the process and only the purified major component streams. Numerous variations of the work expansion, low-temperature refrigeration producing steps of the process are possible and are capable of being combined with the other, warmer temperature features of this invention to achieve the overall benefits thereof. For example, the FIG. 2 system may be modified to produce refrigeration at the 10°–14° K level by eliminating fourth heat exchanger 120 together with exchanger **122*a* and the streams associated therewith. The cold purified helium leaving passage 117 of exchanger 118 may be throttled in valve 121 (without further heat exchange), passed through refrigeration load 124 and returned directly to passage 145 of exchanger 118. Streams 135 and 143 would thereby be eliminated but otherwise, the streams associated with exchanger 118 and expander 146 would remain as shown in FIG. 2.**

Under the foregoing, the FIG. 1 system could of course be modified by the elimination of the major component gas third smallest part stream in line 55 if the final cooling and para-conversion of the withdrawn product in subcooler 34 were not required. The work expanded portion of the pure major component would then constitute all of the lower pressure pure major component for partial rewarming and recirculation to the warm end of the system. Alternatively, additional throttling and expansion cooling steps could be conducted in the cold end of the system using streams derived from the major part of the pure major component in line 38 to provide refrigeration therein. Regardless of such modifications, however, the lower pressure pure major component which is partially rewarmed and recirculated to the warm end of the process must be comprised at least in part of the work expanded portion of the pure major component.

Although preferred embodiments of this invention have been described in detail it will be appreciated that other embodiments are contemplated only with modification of the disclosd features, as being within the scope of the invention.

What is claimed is:

1. A low temperature refrigeration process, comprising the steps of:

a. providing a feed gas mixture at superatmospheric pressure comprising a major component selected from the group consisting of hydrogen and helium, and at least 5% by volume of a minor component having a normal boiling point of at least 170° K and a molecular weight of at least 28;

b. cooling the feed gas mixture to a temperature of between 80° and 140° K and above the freezing point of the minor component for liquefaction of said minor component, and separating the liquefied minor component from the cooled feed gas mixture to produce cooled minor component-depleted feed gas;

c. contacting said cooled minor component-depleted feed gas with an adsorption zone at the low temperature of step (b) for selective removal of the residual minor component therein and discharging pure major component from said zone;

d. further cooling at least part of said pure major component to a temperature at about its boiling point;

e. expanding a portion of said pure major component to lower pressure with the production of external work and cooling thereof to lower temperature above its boiling point;

f. partially rewarming lower pressure pure major component comprised at least in part of said work expanded portion of said pure major component by heat exchange with the pure major component as at least part of said further cooling of step (d);

g. throttling the separated liquefied minor component of step (b) to the lower pressure of the partially rewarmed pure major component, of step (f) and joining the throttled liquefied minor component with the partially rewarmed pure major component to form a recycle gas mixture;

h. further rewarming said recycle gas mixture to vaporize the liquefied minor component therein by heat exchange with the feed gas mixture as at least part of said cooling of step (b); and i. dynamically compressing the further rewarmed recycle gas mixture and providing same as at least the major fraction of said superatmospheric pressure feed gas mixture of step (a).

2. A process according to claim 1 wherein the minor component comprises at least one constituent selected from the group consisting of propane, propylene, ethane, ethylene, chlorotrifluoromethane, dichlorodifluoromethane and tetrafluoromethane.

3. A process according to claim 1 wherein the pure major component is hydrogen and the minor component comprises propane.

4. A process according to claim 1 wherein the pure major component discharged from the adsorption zone in step (c) is additionally cooled to below the temperature of the cooled minor component-depleted feed gas and divided into a major part and a minor part, the major part comprising the portion of the pure major component for expansion to lower pressure in step (d) and the minor part comprising the part of said pure major component further cooled in step (d), and wherein said further cooling is to a temperature lower than the boiling point of the pure major component and said further cooled part of said pure major component is discharged as liquid product at lowest process temperature.

5. A process according to claim 4 wherein hydrogen is the pure major component and is contacted with an ortho/para conversion catalyst during said further cooling to produce liquid hydrogen product having a para content greater than 25%.

6. A process according to claim 4 wherein said major part of the pure major component is divided, with a first smaller part thereof being work expanded to an intermediate pressure and a second larger part being work expanded to a lower-than-intermediate pressure, said first smaller and second larger parts of pure major component are partially rewarmed as said step (f), said separated liquefied minor component of step (b) is divided into two parts, with a first part being throttled to said intermediate pressure and a second part being throttled to said lower-than-intermediate pressure, said first part liquefied minor component is joined with said first smaller part pure major component to form a first intermediate pressure part of said recycle gas mixture and said second part liquefied minor component is joined with said second larger part pure major component to form a second lower-than-intermediate pressure part of said recycle gas mixture, and after said further rewarming said second part recycle gas mixture is dynamically compressed to the intermediate pressure of said first part recycle gas mixture and joined therewith to form said recycle gas mixture for further dynamical compression and provision thereof as at least the major fraction of said superatmospheric pressure feed gas mixture of step (a).

7. A process according to claim 1 wherein activated charcoal is provided as the adsorbent material in said adsorption zone.

8. A process according to claim 1 wherein said cooled minor component-depleted feed gas is contacted with an adsorption zone comprising at least two adsorbent beds arranged for alternating sequential operation wherein pure major component is employed for purging of a bed having previously been at least partially loaded with residual minor component and the gas removed from said bed during desorption thereof is recycled to provide a constituent of the recycle gas mixture.

9. A process according to claim 1 wherein at least a major fraction of the pure major component further cooled in step (d) is thereafter divided into at least two parts including a minor part and a major part, said minor part is throttled to provide pure major component at lowest process temperature and passed in direct heat exchange relationship with said pure major component as the final part of said further cooling of step (d) and said major part, heat exchanged minor part and said work expanded portion of the pure major component are partially rewarmed as the lower pressure pure major component in step (f).

10. A process according to claim 9 wherein the pure major component is helium and the minor component comprises dichlorodifluoromethane.

11. A process according to claim 9 wherein an external refrigeration load is provided and at least said major fraction of said further cooled pure major component is prewarmed by said external refrigeration load and thereafter is divided into said major and minor parts, said major part at an intermediate pressure is partially rewarmed and further divided into said portion of step (e) and first part recycle gas, said portion is work expanded to a lower-than-intermediate pressure and joined with said heat exchanged minor part to form a second part recycle gas, the liquefied minor component of step (b) is throttled to the lower pressure of the second part recycle gas and joined therewith to form second part recycle gas mixture and thereafter said first part recycle gas and second part recycle gas mixture are further rewarmed, said second part recycle gas mixture is dynamically compressed to the intermediate pressure of said first part recycle gas and joined therewith to form said recycle gas mixture for further dynamic compression and provision thereof as said superatmospheric pressure feed gas mixture of step (a).

12. A low temperature refrigeration process, comprising the steps of:

a. providing a feed gas mixture at superatmospheric pressure comprising hydrogen as the major component, and at least 10% by volume of a minor component having a normal boiling point above 170° K and a molecular weight of at least 28;

b. cooling the feed gas mixture to a temperature of between 80° and 140° K and above the freezing point of the minor component for liquefaction of said minor component, and separating the liquefied minor component from the cooled feed gas mixture to produce cooled minor component-depleted feed gas;

c. contacting said cooled minor component-depleted feed gas with an adsorption zone at the low temperature of step (b) for selective removal of the residual minor component therein and discharging pure hydrogen from said zone;

d. additionally cooling said pure hydrogen to below the temperature of the cooled minor component-depleted feed gas and dividing same into a major part and a minor part;

e. further cooling the minor part of the pure hydrogen to a temperatuare below its boiling point, contacting the minor part hydrogen with an orotho/-para conversion catalyst during said further cooling and discharging the further cooled liquid hydrogen as product having a para content of at least 50% and at lowest process temperature;

f. further dividing the major part of the pure hydrogen into three parts comprising a first smaller part, a second larger part and a third smallest part, expanding the first smaller part to an intermediate pressure with the production of external work and cooling thereof to lower temperature above its boiling point, expanding the second larger part to a lower-than-intermediate pressure with the production of external work and cooling thereof to lower temperature above its boiling point, and cooling said third smallest part for liquefaction thereof and passing same in heat exchange relationship with said minor part of the pure hydrogen as the final part of said further cooling of step (d), whereby the third part liquid is revaporized;

g. partially rewarming lower pressure pure hydrogen, comprising the work expanded first smaller and second larger parts and the revaporized third part, by heat exchange with the minor part of the pure hydrogen as at least part of said further cooling of step (e).

h. dividing the separated liquefied minor component of step (b) into two parts and throttling the first part to said intermediate pressure and throttling the second part to said lower-than-intermediate pressure, joining said throttled first part liquefied minor component with the partially rewarmed first smaller part and revaporzied third part hydrogen to form a first intermediate pressure part recycle gas mixture and said second part liquefied minor component is joined with the partially rewarmed second larger part pure hydrogen to form a second lower-than-intermediate pressure part recycle gas mixture;

i. further rewarming said first part and second part recycle gas mixtures to vaporize the liquefied minor component therein by heat exchange with the feed gas mixture as at least part of said cooling of step (b); and j. dynamically compressing said second part recycle gas mixture to said intermediate pressure of said first part recycle gas mixture, joining said compressed second part recycle gas mixture with said first part recycle gas mixture to form a recycle gas mixture and further dynamically compressing said recycle gas mixture and providing same as at least the major fraction of said superatmospheric pressure feed gas mixture of step (a).

13. A low temperature refrigeration process, comprising the steps of:

a. providing a feed gas mixture at superatmospheric pressure comprising helium as the major component, and at least 10% by volume of a minor component having a normal boiling point above 170° K and a molecular weight of at least 28;

b. cooling the feed gas mixture to a temperature of between 80° and 140° K and above the freezing point of the minor component for liquefaction of said minor component, and separating the liquefied minor component from the cooled feed gas mixture to produce cooled minor component-depleted feed gas;

c. contacting said cooled minor component-depleted feed gas with an adsorption zone at the low temperature of step (b) for selective removal of the residual minor component therein and discharging pure helium from said zone;

d. further cooling said pure helium to a temperature at about its boiling point;

e. providing an external heat load, prewarming at least a major fraction of the further cooled pure helium by said external refrigeration load and thereafter dividing said fraction into a major part and a minor part;

f. throttling said minor part to provide pure helium at lowest process temperature and passing same in indirect heat exchange relationship with the pure helium being further cooled in step (d), as the final part of said further cooling;

g. further dividing said major part pure helium at an intermediate pressure into a portion for expansion and a second part recycle gas, and work expanding said portion to a lower-than-intermediate pressure;

h. partially rewarming lower pressure pure major component comprising said work expanded portion, said second part recycle gas and the heat exchanged minor part pure helium of step (f) by heat exchange with the pure helium as at least part of said further cooling of step (d);

i. joining said work expanded portion with said heat exchanged minor part pure helium to form a first part recycle gas;

j. throttling the separated liquefied minor component of step b) to the lower pressure of the partially rewarmed first part recycle gas of step (i) and joining same to form a first part recycle gas mixture;

k. further rewarming said first part recycle gas mixture to vaporize the liquefied minor component therein and said second part recycle gas by heat exchange with the feed gas mixture as at least part of said cooling of step (b); and l. dynamically compressing said further rewarmed second part recycle gas mixture to the intermediate pressure of said first part recycle gas and joining same to form a recycle gas mixture, further dynamically compressing said recycle gas mixture and providing same as said superatmospheric pressure feed gas of step (a).

14. A process according to claim 12 wherein the third smallest part of the major part of the pure hydrogen is throttled to the lower-than-intermediate pressure of said second larger part as at least part of said cooling for liquefaction thereof in step (f).

* * * * *

UNITED STATES PATENT OFFICE
CERTIFICATE OF CORRECTION tent No. 3,992,167 Issue Date November 16,1976 ventor(s) R.A. Beddome

It is certified that error appears in the above-identified patent d that said Letters Patent are hereby corrected as shown below:

olumn 7, line 26, after "vessel", change "20" to --24--.

olumn 8, line 15, after "valve", insert --59--.

olumn 12, line 59, delete "second" and substitute therefor --first-- olumn 12, line 63, delete "temperature" and substitute therefor -- a flow rate--.

olumn 13, line 48, delete "102" and substitute therefor -- 101 --.

olumn 17, line 46, delete "(d)" and substitute therefor -- (e) --.

olumn 19, line 53, after "part", delete "and revaporzied third part" and substitute therefor -- pure --.

olumn 19, line 57, after "part", insert -- and revaporized third part --.

olumn 20, line 37, delete "second" and substitute therefor --first-- olumn 20, line 46, delete "first" and substitute therefor --second-- olumn 20, line 50, delete "first" and substitute therefor --second-- olumn 20, line 52, delete "first" and substitute therefor --second--

Signed and Sealed this

Twenty-second Day of February 1977

[SEAL]

*Attest:*

RUTH C. MASON
*Attesting Officer*

C. MARSHALL DANN
*Commissioner of Patents and Trademarks*